US008756812B2

(12) United States Patent
White

(10) Patent No.: US 8,756,812 B2
(45) Date of Patent: Jun. 24, 2014

(54) AIR COOLED HEAT SHIELD

(76) Inventor: James E. White, Greenwich, OH (US)

( * ) Notice: Subject to any disclaimer, the term of this patent is extended or adjusted under 35 U.S.C. 154(b) by 198 days.

(21) Appl. No.: 12/785,094

(22) Filed: May 21, 2010

(65) Prior Publication Data

US 2010/0224261 A1 Sep. 9, 2010

Related U.S. Application Data

(62) Division of application No. 11/263,309, filed on Oct. 31, 2005, now Pat. No. 7,842,396.

(60) Provisional application No. 60/623,496, filed on Oct. 29, 2004.

(51) Int. Cl.
*B21D 51/16* (2006.01)

(52) U.S. Cl.
USPC ..... 29/890.08; 29/890.03; 428/597; 428/132

(58) Field of Classification Search
USPC ..... 428/597, 596, 131; 29/896.3, 890.3, 29/890.08; 181/211–283
See application file for complete search history.

(56) References Cited

U.S. PATENT DOCUMENTS

| | | | | | |
|---|---|---|---|---|---|
| 285,068 | A | * | 9/1883 | Poor | 188/56 |
| 1,341,126 | A | * | 5/1920 | Heller | 165/134.1 |
| 2,016,254 | A | * | 10/1935 | Noblitt et al. | 181/251 |
| 2,066,467 | A | * | 1/1937 | Gray | 181/247 |
| 2,099,858 | A | * | 11/1937 | Haas et al. | 181/250 |
| 2,180,373 | A | * | 11/1939 | Sibley et al. | 52/407.1 |
| 2,835,336 | A | * | 5/1958 | Deremer | 181/282 |
| 2,969,586 | A | * | 1/1961 | Victor | 428/597 |
| 3,289,497 | A | * | 12/1966 | West | 76/24.1 |
| 3,313,373 | A | * | 4/1967 | Marx | 181/252 |
| 3,522,863 | A | * | 8/1970 | Ignoffo | 181/252 |
| 3,561,562 | A | * | 2/1971 | Ignoffo | 181/247 |
| 3,604,490 | A | * | 9/1971 | Bricker | 241/273.2 |
| 3,981,689 | A | * | 9/1976 | Trelease | 52/244 |
| 4,083,694 | A | * | 4/1978 | Takeda et al. | 422/198 |
| 4,184,565 | A | * | 1/1980 | Price et al. | 181/252 |
| 4,252,212 | A | * | 2/1981 | Meier | 181/248 |
| 4,338,284 | A | * | 7/1982 | Ignoffo | 422/171 |
| 4,478,310 | A | * | 10/1984 | Harter | 181/241 |
| 4,609,067 | A | * | 9/1986 | Gonwa | 181/211 |
| 5,424,139 | A | * | 6/1995 | Shuler et al. | 428/596 |
| 5,550,338 | A | * | 8/1996 | Hielscher | 181/290 |
| 5,555,932 | A | * | 9/1996 | Dudley | 165/135 |
| 5,902,692 | A | * | 5/1999 | Batawi | 429/439 |
| 5,958,603 | A | * | 9/1999 | Ragland et al. | 428/595 |
| D468,598 | S | * | 1/2003 | Mistretta | D7/678 |
| 6,510,921 | B2 | * | 1/2003 | Price | 181/264 |
| 6,555,246 | B1 | * | 4/2003 | Zwick | 428/596 |
| 6,994,902 | B2 | * | 2/2006 | Fukunaga et al. | 428/131 |
| 2006/0065483 | A1 | * | 3/2006 | Thomas | 181/293 |

OTHER PUBLICATIONS

Brian Ley, "Diameterof a Human Hair" 1999, <http://hypertextbook.com/facts/1999/BrianLey.shtml>.*

* cited by examiner

*Primary Examiner* — Jacob Cigna
(74) *Attorney, Agent, or Firm* — Hahn Loeser & Parks LLP; Bret A. Hrivnak, Esq.

(57) ABSTRACT

A heat shield is disclosed comprising a formed sheet having a thickness, an exterior shielding surface, and an interior shielded surface, wherein the exterior shielding surface comprises a multiplicity of protruding perforations. The protruding perforations comprise protrusions increasing surface area and generating turbulent flow, and small openings through the shield to allow convection air flow to pass through.

20 Claims, 6 Drawing Sheets

AIR COOLED HEAT SHIELD

This application is a divisional application of U.S. patent application Ser. No. 11/263,309, filed Oct. 31, 2005 which is currently pending and claims priority to, and the benefit of, U.S. provisional application Ser. No. 60/623,496, each of which are hereby incorporated by reference.

TECHNICAL FIELD OF THE INVENTION

The present invention relates to a heat shield and, more specifically, to an air-cooled heat reflective shield.

BACKGROUND

Heat shields protect an object or gaseous area from heat. More specifically, in many applications heat shields attempt to limit conductive, convective, and/or radiant heat transfer. Conductive heat transfer refers to the transfer of heat across a medium, whether the medium is solid or fluid. Convective heat transfer occurs between a moving fluid and a surface of an object. Radiant heat transfer occurs when excited atoms emit electromagnetic radiation, which travels from the heat source to a distant object.

One method used to protect against the transfer of heat is to place a barrier, such as a sheet of metal, which is generally thermally conductive material, between the heat source and the protected object or gaseous area. A surface of the barrier exposed to the heat source may reflect some indirect heat, but it also absorbs some of the heat. As some of the heat is absorbed, the exposed surface becomes heated. One disadvantage of this prior art is that the conductive properties of the barrier cause the surface heat to flow through the barrier by way of conduction, ultimately heating the opposing or protected shield surface. The elevated temperature of the protected surface then increases heat transfer from the protected surface of the barrier to the object or area that the barrier is trying to protect.

Efforts to reduce the effects of radiant heat include constructing barriers from thicker, reflective, or low thermal conductivity materials. Also, numerous shields of complex design have been employed. While the trend has been to develop new materials and more complex designs, the industry has lost sight of providing an improved heat shield at a reasonable cost.

The foregoing illustrates limitations known to exist in heat shields. Thus, it is apparent that it would be advantageous to provide an alternative directed to overcoming one or more of the limitations set forth above.

SUMMARY OF THE INVENTION

In first embodiment, the invention comprises a heat shield having: a heat reflective sheet having a thickness bounded by a first sheet surface and a second sheet surface; and means for providing improved convective heat transfer from the sheet while substantially limiting the passage of radiant heat through the sheet, the means comprising: a plurality of convection improving protrusions having a free edge and extending from the first sheet surface; and a plurality of sheet apertures substantially adjacent to at least a portion of the plurality of protrusions, wherein each aperture is bounded by a first edge and a second edge.

In a second embodiment, the invention comprises a heat shield having a heat reflecting sheet, which has a thickness bounded by a first sheet surface and a second sheet surface, the improvement comprising: a plurality of convection improving protrusions having a free edge and extending from the first sheet surface; and a plurality of sheet apertures substantially adjacent to at least a portion of the plurality of protrusions, wherein each aperture is bounded by a first edge and a second edge.

In a third embodiment, the invention comprises a method of limiting the transfer of heat from a heat source to a shielded object, the method comprising the steps of: placing a heat shield of claim 1 between a heat source and a shielded object; wherein the first surface is exposed to an air flow.

The advantages of the improved heat shield will be apparent upon review of the detailed description of the present invention and associated drawings below.

DETAILED DESCRIPTION OF THE INVENTION

Figure 1:
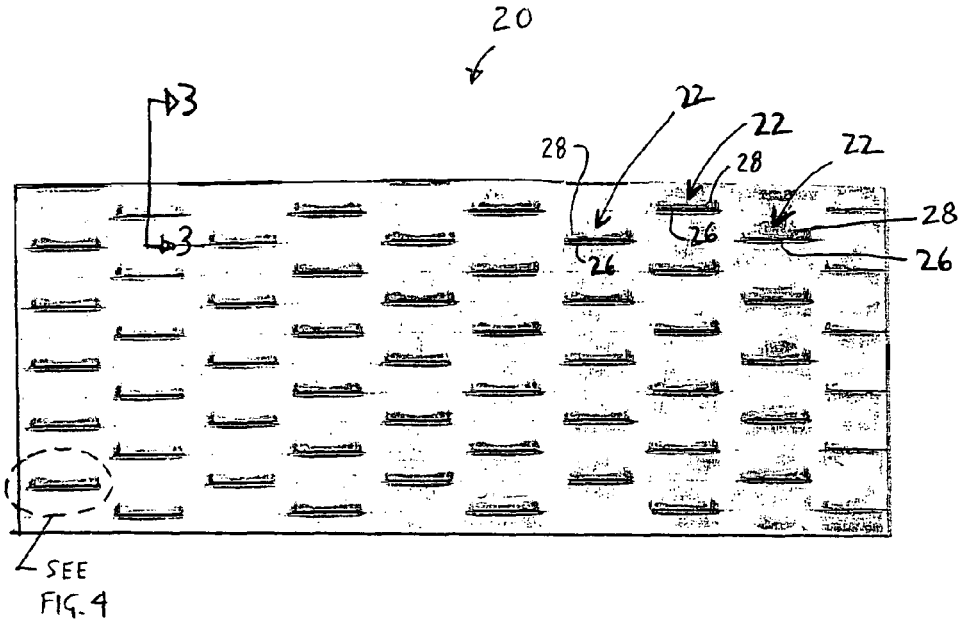
FIG. 1 is a top view of a sheet of a first embodiment of an improved air cooled heat shield.
Figure 2:
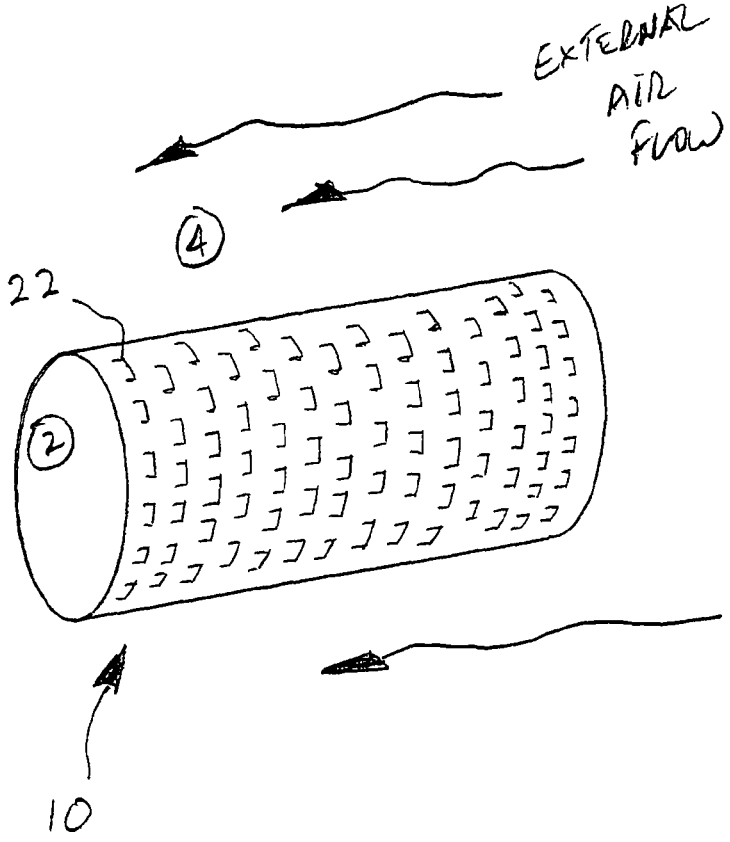
FIG. 2 is a side perspective view of an improved air cooled heat shield.

Referring to FIGS. 1 and 2, a heat reflective sheet 20 is used to create an air-cooled heat shield 10. In this embodiment, the heat reflective sheet 20 comprises a plurality of protruding perforations 22. It is contemplated that the plurality may comprise a pattern, whether uniform or non-uniform, or may be arbitrary. The protruding perforations 22 provide apertures 26 for air to pass through, and protrusions 28 provide both added surface area and surface irregularities for turbulence generation. Still, the sheet 20 may continue to have a relatively macroscopically flat thickness. These features substantially maintain the radiant heat shielding properties of the shield 10, while providing increased cooling for the shield 10. Consequently, less heat is transferred to the protected object or area because the shield 10 operates at a cooler relative temperature.

Figure 4:
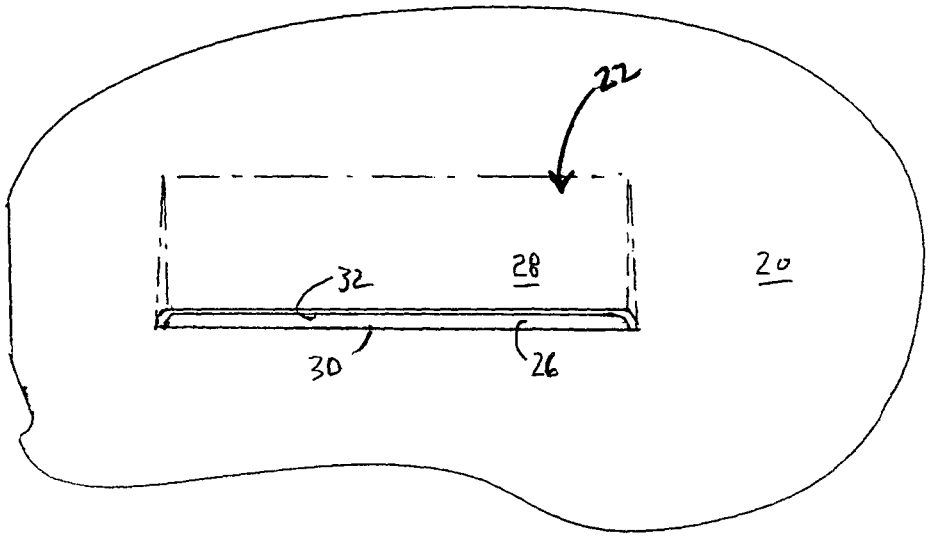
FIG. 4 is a top view of a protruding perforation of FIG. 1.

In the material of FIG. 1, the protruding perforations 22 comprise apertures 26 adjacent to protrusions 28. As shown in FIG. 4, the apertures 26 comprise a first edge 30 and a complementary second edge 32, the second edge also being a free edge of the protrusion 28. Consequently, in this embodiment, the aperture 26 and the adjacent protrusion 28 share at least one common edge. However, it is contemplated that apertures 26 may exist independent of protruding perforations 22, meaning that aperture 26 is not formed solely by forming edges 30, 32 by shearing a portion of the sheet 20, but instead may be formed solely by placing a hole in sheet 20 adjacent or substantially near edge 32.

Figure 6:
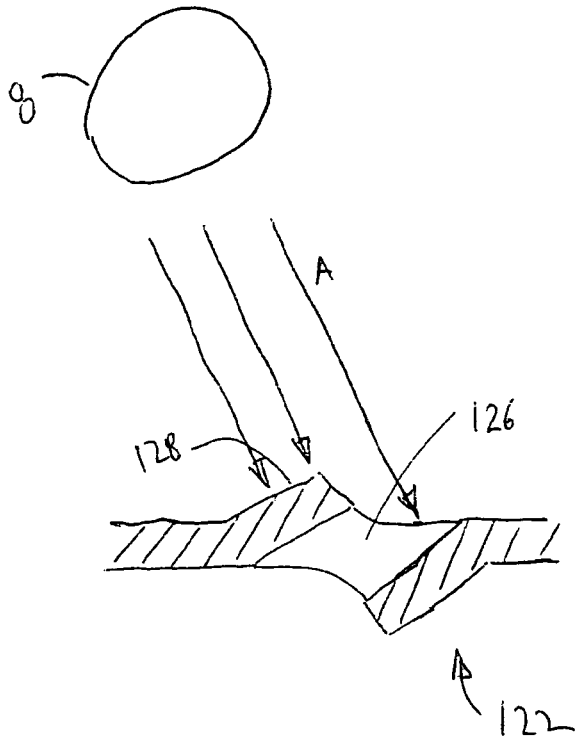
FIG. 6 is a cross-sectional view of the improved heat shield of FIG. 5, through section 6-6 of FIG. 5.

Radiant heat shields attempt to reflect a portion of the radiant heat away from a protected object or area. However, a portion of the heat is inherently absorbed by the shield. In an effort to prevent the shield from arriving at the temperature of the heat source, the shield must be cooled. A primary means of cooling the shield is by way of convection with a surrounding fluid or medium, such as air. The protrusions 28 increase convective heat transfers rates by increasing the surface area and by generating turbulent flow when the surrounding fluid is moving there over. This increased rate allows more heat to be transferred away from the shield and into the fluid flow. Even though the fluid becomes more heated, the protected object is better protected since the fluid directs the additional heat downstream and, because the shield is cooler, the amount of heat radiating and convecting from the shield is reduced. The apertures 26 also provide cooling benefits by injecting cooler air to (or removing heated air from) the exposed side of shield 20. However, the apertures 26 provide the possibility of allowing radiant heat to transmit there through. Therefore, the apertures 26 may be sufficiently small to prevent any significant radiant heat transmission. Further, the protrusions 28 may also assist in preventing any significant radiant heat transmission through complementary apertures 26 by being angled toward the heat source so to be placed substantially between the heat source and the aperture 26. Further, protrusions 28 may fail to fully extend beyond the thickness of the sheet 20, thereby minimizing the size of any aperture 26. Consequently, radiant protection is substantially maintained, as the apertures 26 may be relatively very small and/or not directly exposed to a radiant heat source 8, as illustrated in FIG. 6. Additionally, the slightly extended surface texture created by the protrusions 28 may enhance radiant protection because it reflects the radiation away from the shield 10 at varying angles, as opposed to merely reflecting the radiation back and forth between the heat source 8 and the shield 10.

In one embodiment, sheet 20 is oriented to direct fluid flow over protrusions 28, such that the edge 32 of a protrusion 28 is on the upstream portion of the protrusion 28. To the contrary, it is contemplated that fluid flow may also be directed such that edge 32 of a protrusion 28 is on the downstream portion of the protrusion 28, as this may better exhume air from the opposing side by reducing the local fluid pressure (causing air to flow or be sucked from the opposing side to the air stream side). It is also contemplated that the fluid flow may be directed along the shielded or interior side, or the side opposite the side from which the protrusions 28 extend, as similar benefits may be realized. Further, it is contemplated that the protruding perforations 22 may be oriented such that free edge 32 is not the first portion of the perforation 22 contacted by any air flow (or the free edge 32 is on a downstream portion of perforation 22).

Figure 3:
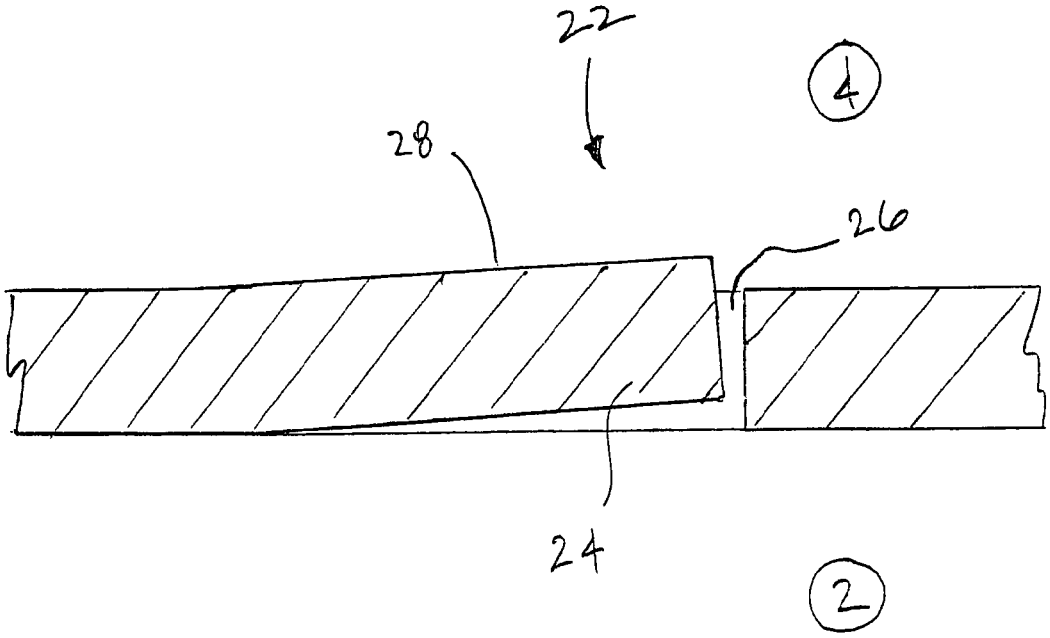
FIG. 3 is a cross-sectional view of the improved heat shield of FIG. 1, through section 3-3.

A metal stamping process may form the apertures 26 and adjacent protrusions 28 of the protruding perforations 22. The metal stamping process uses a shaped stamping die to sequentially manipulate a sheet of material into the heat reflective sheet of the present invention. Referring to FIG. 3, the protruding perforation 22 is formed when the die, comprising at least one die edge, quickly displaces material 24. The sheet material impinged by the die edge separates, or shears, causing a local separation, or perforation, having the second edge 32 on one side of the separation, and the complementary first edge 30 on an opposite side of the separation. The elongated separation or perforation through the sheet forms the aperture 26.

The die shape and displacement causes the material 24 to deform adjacent to the separation or perforation, displacing the second edge 32 and creating the protrusion 28. The die shape may be tapered, creating a continuous, tapered protrusion 28 as illustrated in FIGS. 3 and 4. When the die shape is tapered, the angle of incline may be used to define the amount of displacement of material 24. In the embodiment of FIGS. 3 and 4, the complementary first edge 30 is substantially undeformed, causing the resulting protruding perforations 22 to approximate the shape of louvers. However, it is contemplated that other die shapes can displace material 24, and consequently the protrusion 28 may embody other shapes and configurations without departing from the scope of the present invention. Further, it is contemplated that aperture 26 may be formed independent or at least partially independent of perforated protrusion 22, for example, by forming aperture 26 by tapping or stamping a hole in the material 24 before deforming the sheet 20 to form protrusion 28.

The size and shape of aperture 26 may vary depending on the application. In the embodiment of FIG. 1, the length of aperture 26 is approximately between 0.06 and 0.19 inches, or 1.5 and 5.0 millimeters, while the width is approximately between 0.0025 and 0.01 inches, or 0.06 and 0.25 millimeters. More specifically, the aperture 26 may be approximately ⅛ inches or 3 millimeters long, and approximately 0.005 inches or 0.125 millimeters wide. Again, the size of aperture 26 may vary depending upon the heat transfer requirements of the contemplated application. The length of the separation and the amount of displacement of material 24 are factor into determining the size of aperture 26. Both the length of the separation and the amount of displacement of material 24 may vary as necessary to provide the desired heat protection or heat transfer rates, or as otherwise required by the specific application of shield 10. One method to control the amount of displacement of material is to calibrate and control the amount of die movement. In an alternate method, after the die creates an over-sized opening, a secondary process compresses the over-displaced metal until the aperture 26 is the desired size. As shown in FIG. 3, the resulting material deformation at the separation may be less than the thickness of the sheet material. This limits the aperture 26 to a very small opening, because a portion of the separated material remains beneath the exterior surface of the sheet material.

It is contemplated that the amount of deformation of material 24 may vary with the requirements of the specific application. More deformation, and consequently larger apertures 26, may be needed when more pass-through air flow is required, for example, or if the application requires more internal heat release. In the embodiment of FIG. 1, the collective area of the apertures 26 is between approximately 0.5 and 3 percent of the total area. The size of the apertures 26 may vary with the heat transfer requirements of the specific application.

The number of protruding perforations 22 may vary with the size of the protruding perforations 22, the size of the apertures 26, and the heat transfer requirements of the specific application. In the embodiment of FIG. 1, shield 10 comprises approximately 5 to 7 protruding perforations 22 per square centimeter. In this embodiment, the protruding perforations 22 are in a uniform, linear pattern, however it is contemplated that the protruding perforations 22 may lie in other uniform or non-uniform orientations and other uniform or non-uniform patterns as dictated by manufacturing or heat transfer or other design constraints, such as to generate more turbulent flow.

In an alternate embodiment, the amount of deformation or the direction of deformation varies in a uniform or non-uniform pattern across the heat reflective sheet 20. In one embodiment, a portion of the protruding perforations 22 are deformed to extend beyond the exterior surface (or the air flow exposed surface) of the sheet, and a second portion of protruding perforations 22 are deformed to extend in the opposite direction, or beyond the interior surface of the sheet. In one embodiment the amount of deformation of material 24 (or the extension of protrusion 28, or the size of the aperture 26) varies in a uniform or non-uniform pattern across the heat reflective sheet. In yet another embodiment, perforations 22 may be oriented in varied directions in relation to sheet 20, such that certain edges 32 of certain perforations 22 may be oriented different that other edges 32 on other perforations 22.

The sheet material thickness typically ranges between 0.25 to 1.0 millimeters before forming protruding perforations 22, and may comprise carbon steel, stainless steel, copper, aluminum, or other alloys. It is contemplated that thicker or thinner sheets may be required in other applications.

Figure 5:
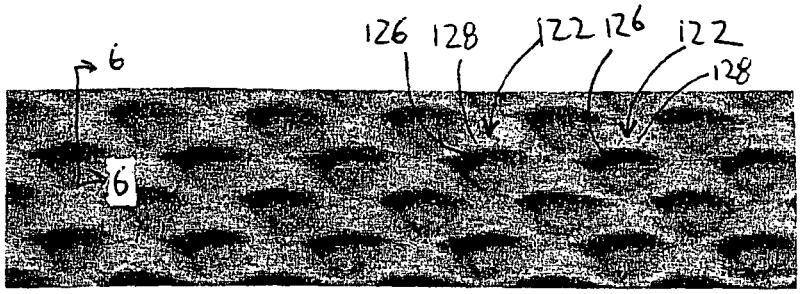
FIG. 5 is a top view of a second embodiment of an improved air-cooled heat shield.

Referring to FIGS. 5 and 6, a second embodiment of heat reflective sheet 120 is shown. This style of the heat reflective sheet 120, formed by the above described shear and deform process, may be used when a larger aperture 126 is required. In this style of the heat reflective sheet, the deformation of material is greater than the thickness of the sheet material. This type of heat reflective sheet may be of use when the radiant source is angled away from, or not adjacent to, the shield 10. This is because the metal stamping process may create inclined protrusions, where portions of surface of the sheet are angled. To minimize the detrimental effects of the enlarged apertures 126 on radiant heat protection, the inclined surface 128 of the protruding perforation 122 may be normal to the radiant source as indicated in FIG. 6. In this way, the shield maintains effective radiation reflection because the aperture 126 is not exposed to direct radiation, shown by arrows A.

The heat shield material of FIGS. 1 and 5 comprising a uniform pattern of very small openings is beneficial as it provides a more uniform cooling capability across the surface, and sheet strength and/or rigidity. Additionally, the uniform pattern of protruding perforations 22, 122 provides a more uniform structure, which may maintain or increase the stiffness and rigidity of the material when bending about an axis perpendicular to the elongated apertures 26, 126. Forming the heat reflective sheet may be easier, however, when bending about an axis parallel to the elongated openings because the apertures 26 may reduce rigidity in this direction.

Depending on the application, the apertures 26, 126 may allow internal heat to escape, or may provide openings for interjecting an internal airflow. In one embodiment, the external airflow is directed to allow a portion to flow onto a face of the protruding perforations 22, 122, through the apertures 26, 126 to the interior 2, and across the interior surface. It is contemplated that the flow may change when disrupted by other turbulence-generating features in alternative perforation 22, 122 geometries.

The protruding perforations 22, 122 also provide improved convection cooling of the shield 10. Improved convection from the shield's 10 external surface results from increased external surface area and the creation of turbulent flow by the surface irregularities. It is commonly known that increasing surface area alone increases the amount of energy transferred. It is also commonly known that turbulent flow increases convection rates. Thus, the protruding perforations 22 allow for more heat to dissipate externally from the heat shield by both increased surface area and turbulent flow, thereby maintaining the exterior surface of the shield 10 at a lower relative temperature. Ultimately, less heat is available to transfer to the object or area being protected.

FIG. 2 illustrates one application of a heat shield 10. The shield 10 is created from the heat reflective sheet 20, 120 by placing the heat reflective sheet 20, 120 between a heat source in the interior 2, such as an exhaust pipe of an automobile, and the object or area to be protected in the exterior 4. Alternately, the protected object, such as a plastic tube or electrical connection, may be in the interior 2 while the heat source, such as an engine exhaust manifold is in the exterior 4.

In an automotive application such as an exhaust pipe heat shield, the movement of the automobile generates airflow over the heat shield. The protruding perforations 22, 122 take advantage of the airflow by causing the flow over the shield 10 to be turbulent. Further, the flow of air passes through the apertures 26, 126 providing enhanced cooling of the interior and exterior surfaces of the shield 10. Experiments show that the apertures 26, 126 can be effectively oriented toward or away from the direction of the airflow. When the apertures 26, 126 are directed into the airflow, the air is forced into the openings. When the apertures 26, 126 are positioned facing away from the airflow, air is drawn through the openings by a venturi effect.

In the application of FIG. 2, shield 10 is configured in the shape of a cylinder, but other applications may require the heat reflective sheet 20, 120 to be manipulated into other forms, such as a box, an angled form, a curved form, or other customized shapes. Because the heat reflective sheet 20, 120 may be thin, it is easily manipulated by a variety of commercially available tools and machines. In use, the shield 10 is fixed, removably or not, into a desirable position by any commercially known method or device, including welding or fastening.

In another application, the shield 10 of FIG. 2 is configured to create an insulating space between the object in the interior 2 and the shield 10. In this embodiment, the space is filled with an insulating material. In one embodiment the insulating material is air. In a second embodiment, the insulating material is an insulator such as fiberglass, asbestos, ceramic, or other commercially available thermal barrier.

While this invention has been described with reference to preferred embodiments thereof, it shall be understood that such description is by way of illustration and not by way of limitation. Accordingly, the scope and content of the present invention are to be defined only by the terms of the appended claims.

What is claimed is:

1. A method of limiting the transfer of heat from a heat source to a shielded object, the method comprising the steps of:

providing a heat shield having a heat reflective sheet, the sheet having a thickness bounded by a first sheet side and a second sheet side, the first sheet side having a first sheet surface and the second sheet side having a second sheet surface, the sheet having:

a plurality of protrusions having a free edge and extending outwardly from the first sheet side; and, a plurality of sheet apertures formed within the sheet, each aperture being positioned substantially adjacent to at least a portion of one of the protrusions and being bounded at least in part by the free edge of the one of the protrusions;

placing the heat shield between a heat source and a shielded object; and, exposing the first sheet side to an air flow directed across the first sheet side the air flow receiving heat transferred from the heat shield, each of the one or more protrusions extending from the first sheet side a distance less than the thickness of the sheet.

2. The method of claim 1, wherein the step of placing also includes:

angling at least one protrusion so to place the protrusion substantially between the heat source and the adjacent aperture.

3. The method of claim 1, wherein the step of placing also includes:

forming the shield at least around a portion of the protected object to better protect the object from direct or indirect heat originating from the heat source.

4. The method of claim 1, wherein the step of placing the heat shield further comprises:

providing an insulating space between the heat shield and the heat source or the protected object; and, placing an insulating material within the insulating space between the heat shield and the heat source or the protected object.

5. The method of claim 1, wherein the direction of air flow into each free edge of the protrusions generates turbulence in the air flow.

6. The method of claim 1, wherein the protrusion is arranged relative to the heat source to substantially shield the aperture from radiant heat emanating from the heat source.

7. The method of claim 1, wherein both the first and second sheet sides are exposed to the air flow.

8. The method of claim 1, wherein the apertures are approximately between 1.5 and 5.0 millimeters long.

9. The method of claim 1, wherein the apertures are approximately between 0.06 and 0.25 millimeters wide.

10. The method of claim 1, wherein the aperture is complementary to the protrusion.

11. The method of claim 1, wherein the free edge of each protrusions extends fully beyond the first sheet side.

12. The method of claim 1, wherein the portion of each of the plurality of protrusions extending furthest from the first sheet side is the free edge.

13. The method of claim 1, wherein the step of placing the heat shield between a heat source and a shielded object includes spacing the second sheet surface from the shielded object to create an air space between said second sheet surface and the shielded object, the first sheet surface being exposed to air flow.

14. The method of claim 1, wherein the air flow is arranged between the heat source and the heat shield.

15. The method of claim 1, wherein the plurality of protrusions and the plurality of apertures are formed along the sheet in a non-uniform pattern.

16. The method of claim 1, where the air flow is directed into the free edge of each of the plurality of protrusions, where the plurality of protrusions are spaced apart along the first sheet surface in a direction of the air flow where the air flow first engages each protrusion of the plurality of protrusions at the free edge of each protrusion, such that the air flow is at least partially directed over each protrusion along the first sheet side to facilitate the transfer of heat from the heat shield and into the air flow.

17. The method of claim 1, wherein the plurality of protrusions and the plurality of apertures are formed along the sheet in a uniform-pattern.

18. The method of claim 17, wherein each of the plurality of apertures is bounded at least in part by a sheet edge and the free edge of the one of the protrusions.

19. The method of claim 18, wherein the sheet edge remains substantially undeformed.

20. The method of claim 18, wherein the free edge of each protrusion comprises a single free edge.

* * * * *